US005435275A

United States Patent [19]

Bergsten et al.

[11] Patent Number: 5,435,275

[45] Date of Patent: Jul. 25, 1995

[54] ARRANGEMENT FOR DISTRIBUTION OF COOLING LIQUID IN AN INTERNAL COMBUSTION ENGINE COOLING JACKET

[75] Inventors: Lars Bergsten, Järna; Eine Wallin, Södertälje; Per Gillbrand, Mariefred, all of Sweden

[73] Assignee: Saab Automobile Aktiebolag, Sweden

[21] Appl. No.: 267,964

[22] Filed: Jun. 28, 1994

[30] Foreign Application Priority Data

Jul. 9, 1993 [SE] Sweden ..... 9302380

[51] Int. Cl.[6] ..... F02B 75/18

[52] U.S. Cl. ..... 123/41.74; 123/41.73

[58] Field of Search ..... 123/41.74, 41.79, 41.82 R, 123/41.73

[56] References Cited

U.S. PATENT DOCUMENTS 1,372,897 3/1921 Nelson .
1,822,857 9/1931 McCuen .
2,845,051 7/1958 Leach .
3,351,044 11/1967 Pomeroy ..... 123/41.73

FOREIGN PATENT DOCUMENTS 2155545 3/1985 United Kingdom .

OTHER PUBLICATIONS

Patent Abstract of Japan-63-12816 (A) (Mazda Motor Corp.) Jan. 20, 1988.

*Primary Examiner*—Noah P. Kamen
*Attorney, Agent, or Firm*—Ostrolenk, Faber, Gerb & Soffen

[57] ABSTRACT

An arrangement for distribution of cooling liquid in the cooling liquid jacket in an internal combustion engine having cylinders disposed in-line in the cylinder block or in a bank of cylinders of the engine. The liquid jacket includes a liquid inlet chamber at one end of the row of cylinders and a liquid outlet chamber at the same end or at the opposite end of the row of cylinders and, in the cylinder block or bank of cylinders with associated cylinder head, mutually interconnected cooling liquid spaces and ducts which communicate with those chambers. In the lower portion of the cooling jacket, a liquid distribution pipe running along the row of cylinders is inserted at one side of the row of cylinders and has at one end a liquid inlet which communicates with the liquid inlet chamber. In the wall of the distribution pipe, liquid outlet holes are provided which are distributed along the distribution pipe and placed and directed in the distribution pipe wall so as to direct cooling water flows towards the cylinder tops and/or the spaces between them. These liquid outlet holes in the wall of the distribution pipe have successively increasing diameters away from the end of the row of cylinders where the liquid outlet chamber is situated. The outlet holes are preferably directed obliquely upwards toward the roof of the cooling jacket.

14 Claims, 4 Drawing Sheets

ARRANGEMENT FOR DISTRIBUTION OF COOLING LIQUID IN AN INTERNAL COMBUSTION ENGINE COOLING JACKET

BACKGROUND OF THE INVENTION

The present invention relates to an arrangement for the distribution of cooling liquid in the cooling jacket of an internal combustion engine, and particularly an internal combination engine having cylinders disposed in-line or in a bank of cylinders in the engine.

The arrangement is applicable in engines in which the cylinders are disposed in-line in the cylinder block (in the case of an in-line engine) or in each bank or row of cylinders (in the case of a vee-engine). In either case, the cooling jacket includes a cooling liquid inlet chamber and a cooling liquid outlet chamber at the ends of the rows of cylinders, and the cylinder block/bank of cylinders with associated cylinder head contains mutually interconnected cooling liquid spaces and ducts which communicate with both chambers.

An internal combustion engine converts approximately only one-fourth of the heat evolved into useful work. The remaining heat has to be led away to prevent engine overheating. When the engine is running at full capacity, the surplus heat is removed by the exhaust gas system, by internal friction, by heating of lubricating oil and by the cooling system. The heat led away by the cooling system may amount to 30-35% of the heat evolved by the engine. An effective cooling system (in the present case, a liquid cooling system) is therefore absolutely necessary for an internal combustion engine to operate properly.

The heat evolved in an internal combustion engine is not evolved uniformly throughout the engine, since certain portions of the engine are particularly subjected to heat, namely the cylinder tops with the combustion chambers, exhaust gas ports and exhaust gas ducts, and the upper portions of the cylinder barrels.

The portions of a liquid cooling system which are part of the engine therefore have to be designed so as to achieve particularly effective cooling for the aforesaid portions of the engine which are most subjected to heat. To this end, a plurality of design solutions have been developed which in different ways endeavor to achieve such "specifically directed" effective cooling of certain portions of an internal combustion engine.

For instance, there is a previously known solution whereby the engine cooling water inlet and outlet are placed at the same end of the engine and a cooling water pipe is inserted in the cooling jacket in order to lead all the cooling water supplied via the cooling water inlet towards the cylinder situated furthest from the inlet, thereby making all the cooling water pass all the cylinders before it reaches the cooling water outlet.

DE A13 810 852 describes a diesel engine which is convertible from oil cooling to water cooling owing to the cylinder head being so designed as to be usable both for oil cooling and for water cooling. To make this possible, there is in the cylinder head a distribution pipe which runs in the longitudinal direction of the cylinder head, serves only as a cooling water line and receives cooling water from the cooling jackets of the cylinders via a plurality of holes in the cylinder head.

EP A10 088 157 describes a cylinder head which is intended for a water-cooled internal combustion engine and in which there are a number of separate cooling water nozzles (orifices) which feed flows of cooling water in between the valves.

U.S. Pat. No. 3,901,300 describes an internal combustion engine in which the cooling system includes separate cooling water nozzles disposed in the cylinder head to create cooling water flows directed towards desired portions of the engine, and U.S. Pat. No. 3,818,878 describes a cylinder head with a cooling liquid conveying arrangement which makes cooling liquid flow between the adjacent exhaust gas ports and around the fuel injection pipe of each cylinder before it can flow on to other portions of the cooling liquid chambers.

U.S. Pat. No. 2,845,051, U.S. Pat. No. 1,822,856, GE,A,2155545 and JP,A63-12816 also show alternatives to distribution pipes.

None of these known arrangements, however, affords a design solution which uses only one flow conveying device to achieve the desired particularly effective cooling of the portions of an engine of the type indicated in the introduction which are most subjected to heat while maintaining substantially equal cooling of each cylinder.

SUMMARY OF THE INVENTION

The invention therefore has an object of achieving effective cooling of the portions most subjected to heat while maintaining substantially equal cooling of all the cylinders in an engine in which the cooling water is supplied and returned via the end or ends of the engine.

A further object is to use a single flow distributing and directing device which is of simple (production-friendly) design, inexpensive, common to all the cylinders in a row of cylinders and insertable in the cylinder block/bank of cylinders for achieving the desired aforesaid particularly effective cooling of the portions most subjected to heat of an internal combustion engine in which the cooling liquid inlet and cooling liquid outlet are situated at the same or opposite ends of the row of cylinders.

The cooling liquid distributing arrangement according to the invention could be used either in an engine in which the cylinder block and associated cylinder head are engine parts which are manufactured separately and thereafter assembled to one another or in an engine in which the cylinder block and cylinder head are made as a single common continuous monobloc element (a so-called monobloc engine).

The above and other objects are achieved according to the invention by an arrangement for distribution of cooling liquid in a cooling liquid jacket in an internal combustion engine having cylinders disposed in-line in the engine cylinder block or in a bank of cylinders in the engine, whereby the liquid cooling jacket includes a liquid inlet chamber at an end of a row of cylinders and a liquid outlet chamber at an end of a row of cylinders and, in the cylinder block or bank of cylinders with associated cylinder head, mutually interconnected cooling liquid spaces and ducts which communicate with those chambers, and further comprising a liquid distribution device inside the cooling jacket on one side of the row of cylinders and running along the row of cylinders, with one end of the liquid distribution device having in it a water inlet which communicates with the water inlet chamber, and further having liquid outlet holes in the wall of the liquid distribution device which are distributed at mutual spacing along the liquid distribution device and being placed and directed in the distribution device wall so as to direct cooling liquid flows radially outward from the liquid distribution device towards at least one of the cylinder tops and spaces between the cylinder tops, the outlet holes in the wall of the liquid distribution device having successively increasing outlet areas from the end of the row of cylinders where the liquid outlet chamber is situated toward the opposite end.

In such a cooling liquid distributing arrangement, a liquid distribution device running along the row of cylinders, preferably in the form of a liquid distribution pipe, is inserted in the cooling jacket on one side of the row of cylinders, preferably the exhaust gas side. One end of the liquid distribution pipe comprises a liquid inlet which communicates with the liquid inlet chamber of the liquid jacket. In the wall of the distribution pipe there are liquid outlet holes distributed at mutual spacings along the pipe. These outlet holes are placed and directed in the pipe wall so that the liquid flowing out through them is directed towards the cylinder tops and/or the spaces between the latter.

The cooling liquid flows from the distribution pipe outlet holes result in the establishment of vertical swirling flows directed upwards towards the ignition plugs between the exhaust gas ducts. The arrangement according to the invention also makes it possible to achieve an even cooling water flow on all the cylinders in the row of cylinders, including the cylinder situated furthest from the cooling liquid inlet chamber. An effective swirling flow of the cooling liquid emerging from the outlet holes can thus be achieved in a vertical direction towards the portions of each cylinder in the engine which are most subjected to heat.

A cooling liquid distributing arrangement according to the invention creates a very production-friendly and inexpensive solution with readily settable local flows with effective cooling offsets on the aforesaid portions most subjected to heat.

It is advantageous for the outlet holes in the wall of the liquid distribution pipe to have successively increasing diameters from the end of the row of cylinders where the liquid outlet chamber is situated. To achieve optimum directing of the cooling liquid flows from the distribution pipe outlet holes and create as effective a swirling flow as possible, it is preferable for the liquid distribution pipe to be disposed horizontally and as low as possible in the cooling jacket and be surrounded by the cooling liquid. This makes the flow from the outlet holes entrain with it the cooling liquid surrounding the distribution pipe, which is advantageous for creating a swirling flow throughout the vertical plane. It is therefore advantageous for the liquid distribution pipe to be inserted in the lower or lowest portion of the cooling jacket, on the exhaust gas side of the row of cylinders. Depending on the position of the respective intended "target areas" for the individual liquid flows, the outlet holes in the wall of the liquid distribution pipe may be directed at the same or different angles obliquely upwards towards the roof of the cooling jacket. The liquid distribution pipe has also, at its opposite end from the end of the row of cylinders where the liquid outlet chamber is situated, a main outlet aperture which communicates with the cooling liquid space of the cooling jacket. The majority of the cooling water supplied by the liquid distribution pipe will therefore flow out via the aforesaid main outlet aperture into a "main cooling flow path" which runs through the cooling jacket in its axial direction from the cooling liquid space of one cylinder to the cooling space of the next cylinder, and so on, via the cooling liquid ducts or apertures which interconnect adjacent cooling liquid spaces, so that it finally reaches the cooling liquid outlet chamber. The main outlet aperture of the liquid distribution pipe thus results in a well-established axial longitudinal cooling liquid flow in the longitudinal direction of the cylinder block/bank of cylinders from one end of the row of cylinders to the cooling liquid outlet end situated at the opposite end of the row of cylinders from the main outlet.

The cooling liquid distributing arrangement according to the invention is particularly advantageous in cases where each cylinder of the engine has two exhaust gas ducts (from two exhaust gas valves) and the cylinder block and associated cylinder head consist of a single continuous monobloc element. In such cases it is advantageous for the liquid outlet holes to be directed upwards the cylinder head regions where the ignition plugs are situated between the two exhaust gas ducts of the cylinders.

To ensure that the cooling liquid flows from the liquid distribution pipe outlet holes really are directed in the intended manner when the liquid distribution pipe is inserted into its longitudinal passage in the cooling jacket, it is advantageous for the liquid distribution pipe to have at one end a position securing device in shape-locking and rotation-preventing engagement with a portion of the cylinder block or bank of cylinders. This position securing device may consist, for example, of a resilient guiding tongue which protrudes from the edge of the inlet end of the distribution pipe and has a radially bent-outwards portion which engages with an internal recess in the cylinder block/bank of cylinders. It is advantageous for this resilient guiding tongue to be so designed that with its free end preloaded it abuts against an assembly plug fixed into the continuation of the pipe in the cylinder block/bank of cylinders. Such a version of the position securing device achieves not only rotational positional securing of the pipe but also resilient axial clamping of the pipe in the cylinder block. This allows the liquid distribution pipe to undergo a certain increase in length due to expansion and also prevents undesirable rattling which might occur with a less securely attached liquid distribution pipe.

It is also advantageous for the liquid distribution pipe to be closed at its opposite end from the liquid inlet end, which may be achieved by the pipe being provided with a centrally placed axially protruding guiding cap which is flexibly supported in a bottom hole in the adjacent wall of the cylinder block or bank of cylinders. This ensures rattle-free fastening of this end of the liquid distribution pipe.

BRIEF DESCRIPTION OF THE DRAWINGS

The cooling liquid distributing arrangement according to the invention will now be described and further explained below with reference to an embodiment illustrated in the accompanying drawings, in which.

DETAILED DESCRIPTION OF THE INVENTION

Figure 1:
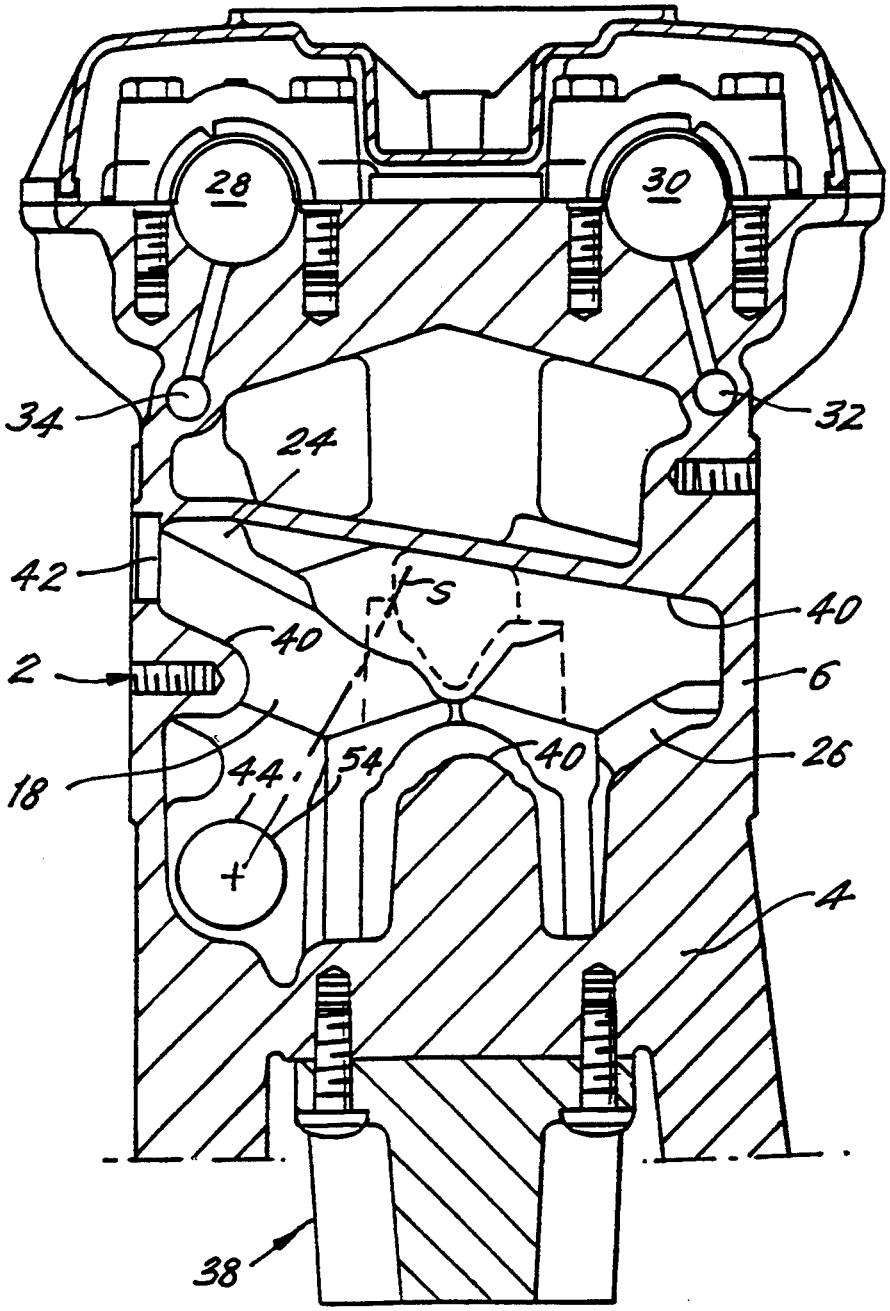
FIG. 1 shows a vertical section through an in-line engine provided with a cooling liquid distributing arrangement according to the invention whereby the section is situated centrally between two of the engine cylinders (at the section line I—I in FIG. 3)
Figure 2:
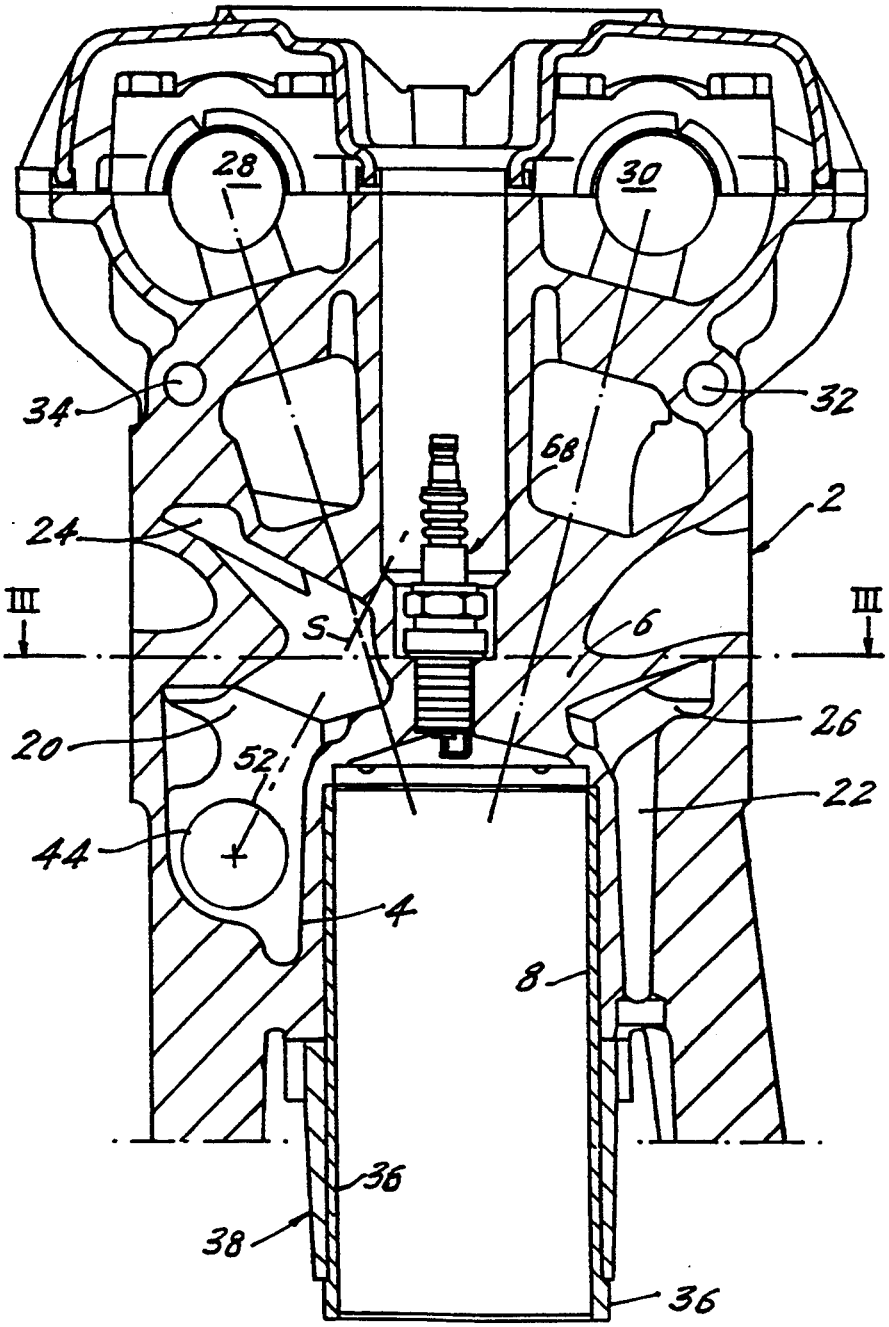
FIG. 2 shows a vertical section through the engine depicted in FIG. 1 whereby the section is situated diametrally through one of the engine cylinders (at the section line II—II in FIG. 3)
Figures 3, 4:
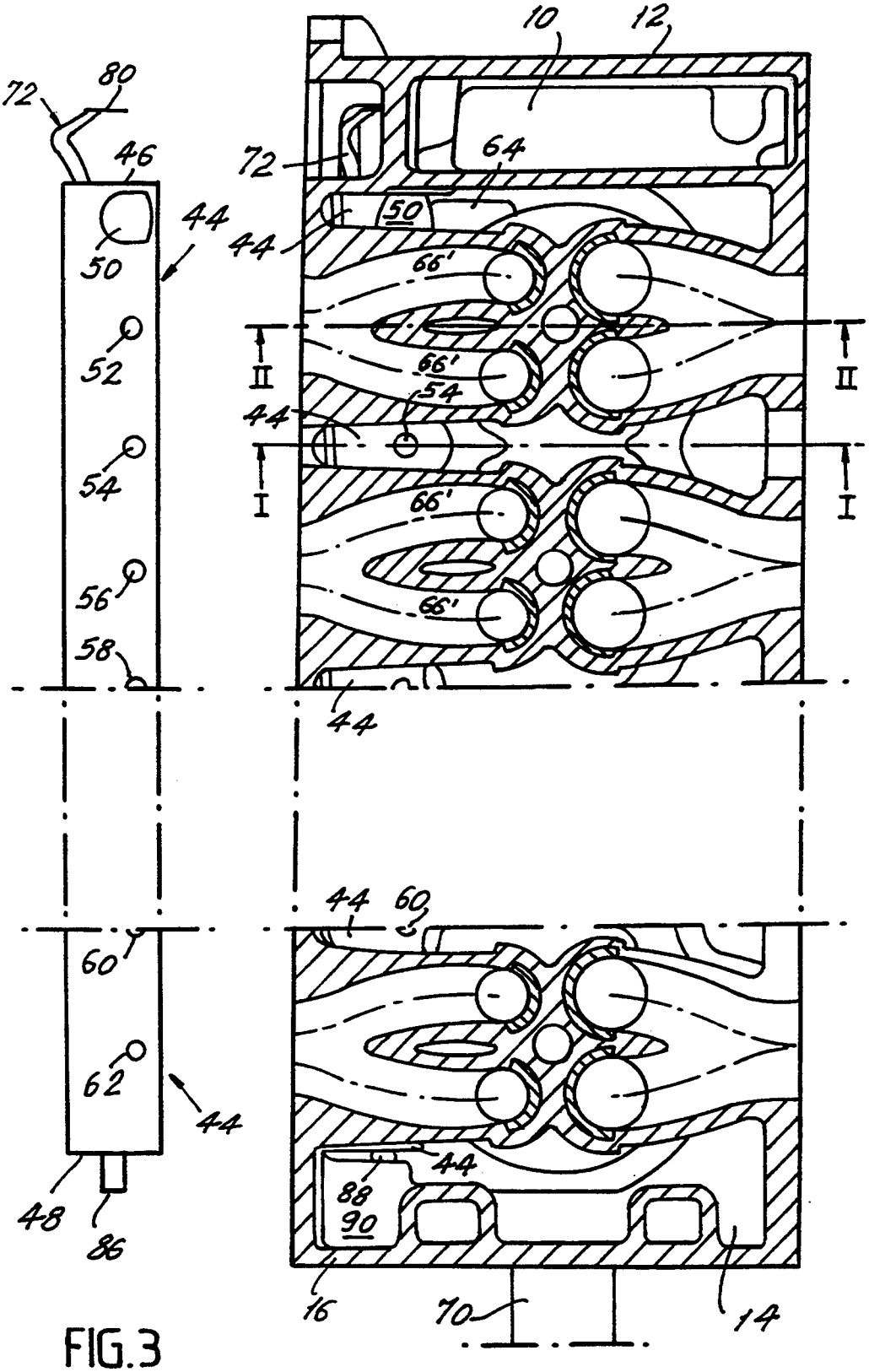
FIG. 3 is a horizontal section through the engine depicted in FIGS. 1–2 along the section line III—III in FIG. 2.
FIG. 4 is a plan view of the liquid distribution line used in the engine according to FIGS. 1–3.

The internal combustion engine 2 depicted in FIGS. 1–3 is an in-line engine of monobloc type, i.e., the cylinder block 4 and cylinder head 6 of the engine are integrated portions of a single continuous monobloc element. However, the invention is not limited to application in a monobloc engine, since the cooling liquid distribution arrangement according to the invention may equally well be incorporated in an engine in which the cylinder block and cylinder head are separately manufactured parts which are assembled together by screwed connection.

The in-line engine depicted in FIGS. 1–3 may, for example, have four or six cylinders 8 which are therefore disposed in-line in engine cylinder block 4. As far as the invention is concerned, it may therefore by considered that what is depicted in FIGS. 1–3 is only one bank of cylinders set obliquely in a vee-engine. Irrespective of whether what is concerned is a cylinder block 4 in an in-line engine or a corresponding bank of cylinders in a vee-engine, it remains the case that the engine cooling liquid jacket includes a liquid inlet chamber 10 at one end 12 (FIG. 3) of the row of cylinders and a liquid spaces 18, 20, 22 which communicate with both chambers, and space-connecting liquid ducts such as the axial transverse connections 24 and 26 in the upper portion of the liquid jacket.

Before going further into the features of the cooling liquid distribution arrangement which distinguish the invention, it should quite briefly be mentioned that the engine is in a usual manner provided at the top with a pair of overhead camshafts 28 and 30 whereby the camshaft 28 operates the exhaust gas valves of the cylinders, while the camshaft 30 operates the inlet valves of the cylinders. In FIGS. 1 and 2, references 32 and 34 denote oil ducts which convey oil to the camshaft bearings. On the underside of the cylinder block 4, the engine 2 is provided with a cylinder liner structure 38 which is common to the cylinder liners 36 of the cylinders 8 and is screwed securely to the underside of the cylinder block 4 by means of fastening screws. The contours of the internal wall which delineates the cooling liquid space 18 shown in FIG. 1 are indicated in the same figure by a somewhat heavier contour line 40. The outer contours of the cooling liquid spaces 20 and 22 in FIG. 2 are also marked by heavier contour lines. In the upper portion of the cooling liquid space 18 a so-called freeze plug 42 is fixed in a known manner in the cylinder head 6.

Reverting now to describing the cooling liquid distributing arrangement according to the invention, a particular distinguishing feature of this arrangement is that a liquid distribution device, preferably in the form of a liquid distribution pipe 44 (with circular cross-section), is inserted in the lower portion of the cooling jacket on the exhaust gas side of the row of cylinders. This liquid distribution pipe 44, which is seen most clearly in FIG. 4, thus runs along the row of cylinders 8 in the cylinder block/bank of cylinders and passes through the cooling liquid spaces 18 and 20 of all the cylinders.

The liquid distribution pipe 44 has at one end a liquid inlet 46 which communicates freely with the water inlet chamber 10. The opposite end of the liquid distribution pipe 44 is closed by means of a cup-shaped plug 48 welded or bonded securely to the pipe end, as may most clearly be seen in FIG. 6.

In the encasing wall of the distribution pipe 44 there are liquid outlet holes 50, 52, 54, 56, 58, 60 and 62 distributed at mutual spacings along the distribution pipe. The outlet holes 52–62 in the wall of the liquid distribution pipe 44 have, as may be seen in FIG. 4., successively decreasing diameters from the pipe liquid inlet end 46 towards its opposite end 48, or successively increasing diameters from the end of the row of cylinders where the liquid outlet chamber 14 is situated. The outlet holes 52–62 are placed and directed in the encasing wall of the distribution pipe 44 so that cooling liquid flows are directed upwards (e.g. in the direction S) towards the cylinder tops and/or the spaces between them.

As illustrated in FIG. 4, the liquid distribution pipe 44 has near to its liquid inlet end 46 a main outlet aperture 50 with a considerably larger diameter than the outlet holes 52–62. This main outlet aperture 50 places the inside of the liquid distribution pipe 44 in communication with the cooling liquid space 64 which is part of the cooling jacket and which is situated adjacent to the liquid inlet chamber 10. It is quite generally the case that the outlet holes 52–62 in the wall of the liquid distribution pipe 44 are directed obliquely upwards towards the roof of the cooling jacket. It is more particularly the case that the liquid outlet holes 52, 56, 62 on the distribution pipe are directed upwards to between two exhaust gas ducts 66′ and 66″ from the respective cylinder 8 and preferably into the region of the cylinder head where the ignition plugs 68 are situated in the case of an engine where the ignition plug is placed centrally in the combustion chamber roof.

In the embodiment illustrated in FIGS. 3 and 4, every second hole 52, 56, 62 after the main outlet aperture 50 is directed upwards to between two exhaust gas ducts pertaining to the respective cylinders, and the intermediate holes 54, 58, 60 are directed upwards to between cylinders. The portions most subjected to heat thus receive more forceful cooling by means of the distribution pipe according to the invention, which can easily be set for different flows by adapting the sizes of the outlet holes 52–62.

The main outlet aperture 50 is used to supply the cooling liquid which from the cooling liquid space 64 constitutes the primary longitudinal cooling liquid flow past all the cylinders 8 in the cylinder block 4 to the liquid outlet chamber 14 and from there out through the engine end outlet 70 at the end 16 of the cylinder block. The outlet holes 52–62 help to create in a vertical plane perpendicular to the longitudinal direction of the engine a swirling flow superimposed upon the flow created in the cooling jacket in the longitudinal direction. The portions of the cooling jacket which are situated behind cylinders and the like on the downstream side of the flow created in the longitudinal direction often form more or less stagnant volumes of cooling liquid, but the distribution pipe according to the invention creates a flow in these volumes as well.

Figure 5:
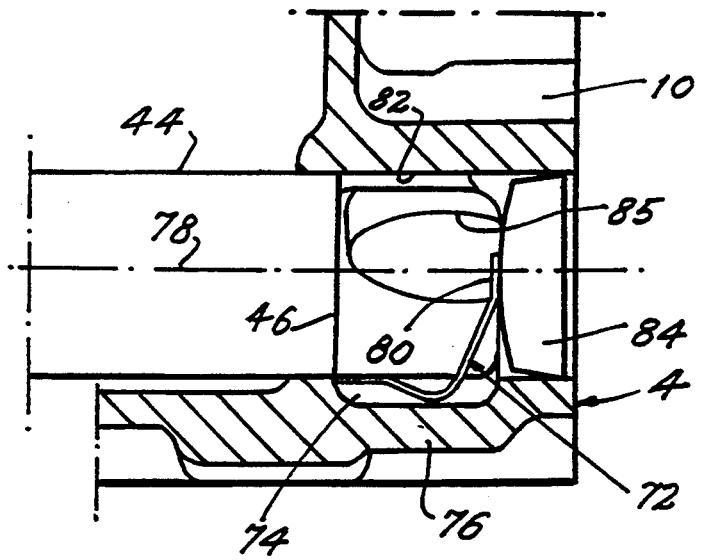
FIG. 5 is a diametral section on a larger scale through the inlet end portion of the liquid distribution pipe shown in FIG. 4.
Figure 6:
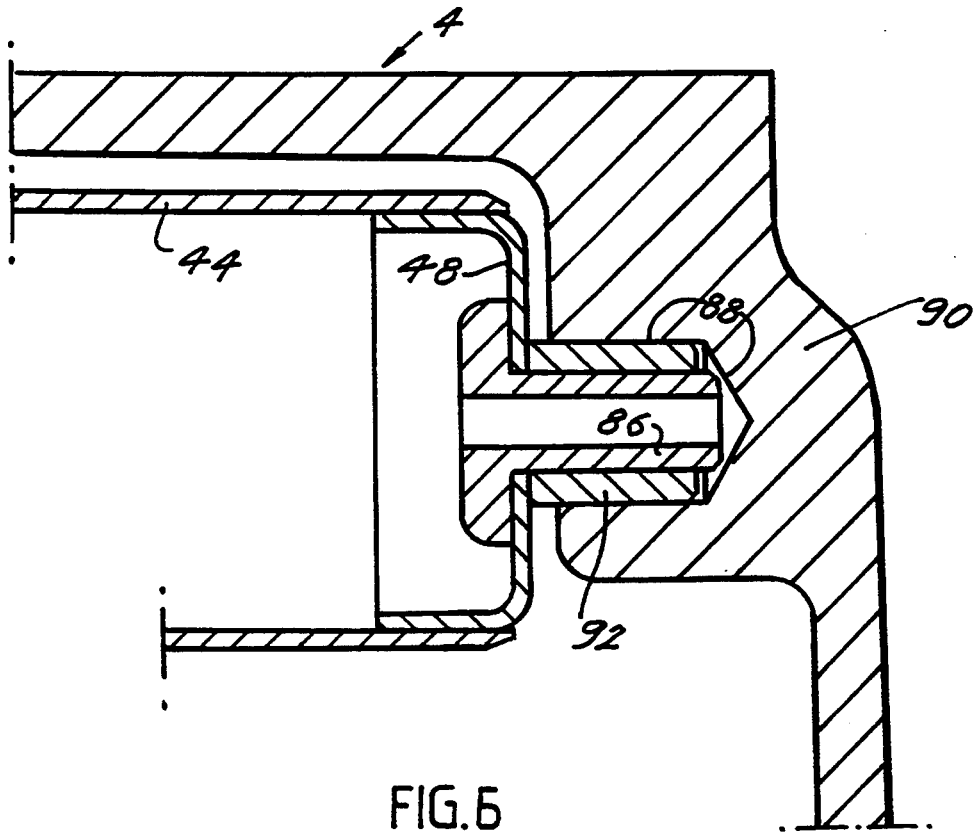
FIG. 6 is a diametral section on a still larger scale through the closed other end of the liquid distribution pipe shown in FIG. 4.

With reference mainly to FIGS. 5 and 6, the fastening of the liquid distribution pipe 44 in the cylinder block 4, more precisely, the positional fixing and the accommodation of the ends 46 and 48 of the liquid distribution pipe in the corresponding end portions of the cylinder block 4 are shown. As may be seen in FIGS. 4 and 5, the liquid distribution pipe 44 has an evenly wide resilient guiding tongue 72 which protrudes from the edge of the liquid inlet end 46 of the distribution pipe. This guiding tongue 72 constitutes a position securing device which engages in a shape-locking and rotation-preventing manner with a keyway-shaped recess 74 cast into the inside of the cylinder block endwall portion 76. To achieve the desired rotational securing of the liquid distribution pipe 44 in the cylinder block, the guiding tongue 72 and the recess 74 should have approximately the same width. The guiding tongue's free end 80 situated on the center-line 78 of the distribution pipe 44 abuts preloadedly against a cup-shaped assembly plug 84 which is fixed into the wall portion 76 of a cylindrical pipe extension bore 82 and may also constitute a freeze plug. The cooling liquid from the liquid inlet chamber 10 flows to the liquid inlet end 46 of the distribution pipe 44 via an inlet aperture 85 in the endwall portion 76.

At its closed other end, the liquid distribution pipe 44 has, as may be seen in FIG. 6, a cup-shaped plug 48 which is welded or bonded securely into the pipe end and has fixed in its center (e.g. by welding or riveting) an axially protruding guiding pin 86 which is elastically supported in a bottom bore 88 in the endwall portion 90 of the cylinder block 4. This elastic support of the guiding pin 86 in the bottom bore 88 may, for example, consist of a rubber bushing 92 inserted in the bore 90. The fact that the liquid distribution pipe 44 is fastened at both ends means that it is clamped and accommodated in the cylinder block effectively so as to eliminate the risk of the liquid distribution pipe 44 causing rattling in the cylinder block. In an undepicted alternative embodiment it is possible for the situation to be reversed by the endwall portion 90 of the cylinder block being provided with an axial guiding pin which is pressed into a bore and centers in a bore formed in the end of the distribution pipe, with a rubber bushing placed around the guiding pin. The endwall portion 90 may also have a bore through it which supports the encasing surface of the distribution pipe and may be closed by a conventional freeze plug.

The invention is not limited to an engine according to the embodiments illustrated in the drawings whereby the cooling water inlet to the cooling jacket is situated at the opposite end of the row of cylinders from the cooling water outlet. The invention may also be applied to an engine where the inlet and outlet to the cooling jacket are situated at the same end of the row of cylinders. The liquid distribution device does not necessarily have to take the form of a cylindrical pipe. Distribution devices with rectangular or square cross-section or distribution ducts built into the cylinder block may be used alternatively.

In the embodiment illustrated with successively increasing diameters from the end of the row of cylinders where the liquid outlet chamber 14 is situated, the outlets drilled in the liquid distribution device may be replaced by outlet holes of the same diameter but with, for each cylinder, a successively increasing number of outlet holes in the liquid distribution device from the end of the row of cylinders where the liquid outlet chamber 14 is situated. At the end of the liquid distribution device situated furthest from the outlet, a plurality of outlet holes for the particular cylinder may be placed in the encasing surface in substantially the same vertical plane through the liquid distribution device, while the end of the liquid distribution device which is situated nearest to the outlet has only one outlet hole situated in the encasing surfaces in the vertical plane through the liquid distribution device. The essential point is that the combined outlet area of the outlet holes constitutes a successively increasing outlet area from the end of the row of cylinders where the liquid outlet chamber 14 is situated.

An important aspect of the invention is that, at the end of the row of cylinders which is furthest from the liquid outlet chamber, the invention results in the flow of a greater quantity of cooling liquid which establishes the basic flow which subsequently passes all the intermediate cylinders relative to the liquid outlet chamber. This basic flow has to be regarded as providing even cooling of the cylinders, with the addition from each outlet aperture on the liquid distribution device of a smaller quantity to that basic flow, and with the latter having become somewhat warmer, so that only a successively smaller quantity has to be added from the outlet apertures in the liquid distribution device in proportion to their decreasing distance from the liquid outlet chamber at the end of the cylinders.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An arrangement for distribution of cooling liquid in a cooling liquid jacket in an internal combustion engine having cylinders disposed in-line in at least a cylinder bank of an engine cylinder block of the engine, whereby the liquid cooling jacket includes a liquid inlet chamber at an end of a row of cylinders and a liquid outlet chamber at an end of a row of cylinders and having, in the cylinder bank with associated cylinder head, mutually interconnected cooling liquid spaces and ducts which communicate with those chambers, and further comprising a liquid distribution device inside the cooling jacket on one side of the row of cylinders and running along the row of cylinders, with one end of the liquid distribution device having in it a water inlet which communicates with the water inlet chamber, and further having liquid outlet holes in a wall of the liquid distribution device which are distributed at mutual spacing along the liquid distribution device and being placed and directed in the distribution device wall so as to direct cooling liquid flows radially outward from the liquid distribution device towards areas of the cylinder block near tops of the cylinders, the outlet holes in the wall of the liquid distribution device having successively increasing outlet areas from the end of the row of cylinders where the liquid outlet chamber is situated toward the opposite end.

2. The arrangement according to claim 1, wherein the liquid distribution device is a liquid distribution pipe inserted in the cooling jacket.

3. The arrangement according to claim 2, wherein the liquid distribution pipe is inserted in the lower portion of the cooling jacket on the exhaust gas side of the row of cylinders.

4. The arrangement according to claim 1 wherein the outlet holes in the wall of the liquid distribution device are directed radially outwards from the liquid distribution device and obliquely upwards towards the roof of the cooling jacket.

5. The arrangement according to claim 1, wherein the liquid distribution device has a main outlet aperture which is situated at the opposite end of the liquid distribution device from the end of the row of cylinders where the liquid outlet chamber is situated and which communicates with the cooling liquid space of the cooling jacket.

6. The arrangement according to claim 1, wherein each cylinder of the engine has an ignition plug and two exhaust gas ducts associated therewith and the cylinder block with associated cylinder head comprises a single continuous monobloc element, and further wherein a plurality of the liquid outlet holes are placed in an encasing surface of the liquid distribution device and each being disposed in a vertical plane perpendicular to a longitudinal axis of the engine and lying between two exhaust gas ducts for a respective cylinder, the holes being directed upwards towards the piston top regions where the ignition plug is disposed between the two exhaust gas ducts of the cylinders.

7. The arrangement according to claim 1, wherein one end of the liquid distribution device is provided with a position securing device which engages in a shape-locking and rotation-preventing manner with a portion of the cylinder block or the bank of cylinders.

8. The arrangement according to claim 7, wherein the position securing device comprises a resilient guiding tongue which protrudes from an inlet end edge of the liquid distribution device and has a radially bent-outward portion which engages with an internal recess in the cylinder block and has a free end preloadedly abutting against an assembly plug fixed into the cylinder block in line with the distribution device.

9. The arrangement according to claim 1, wherein an end of the liquid distribution device opposite the liquid inlet end is closed and provided with a guiding pin which is placed centrally, protrudes axially and is elastically supported in a hole in an adjacent wall of the cylinder block.

10. The arrangement according to claim 6, further comprising a plurality of liquid outlet holes in the liquid distribution pipe directed toward areas between cylinders.

11. The arrangement according to claim 1, whereas the internal combustion engine comprises an in-line engine.

12. The arrangement according to claim 1, wherein the internal combustion engine comprises a vee-engine.

13. The arrangement according to claim 1, wherein the areas of the cylinder block near tops of the cylinders comprise areas alongside the tops of the cylinders.

14. The arrangement according to claim 1 wherein the areas of the cylinder block near tops of the cylinders comprise spaces between the tops of the cylinders.

* * * * *